United States Patent [19]

Morrow, Sr. et al.

[11] 3,949,881

[45] Apr. 13, 1976

[54] SWING DRIVE ASSEMBLY

[75] Inventors: James G. Morrow, Sr.; David J. Pech, both of Manitowoc, Wis.

[73] Assignee: The Manitowoc Company, Manitowoc, Wis.

[22] Filed: Nov. 11, 1974

[21] Appl. No.: 522,787

[52] U.S. Cl. ..... 212/68; 74/409

[51] Int. Cl.[2] ..... B66C 23/86

[58] Field of Search ..... 212/66, 67, 68, 69; 74/410, 409, 411; 214/132, 133, 134, 135 R, 135 A, 136, 137, 138 R, 138 C; 37/189, 190

[56] References Cited

UNITED STATES PATENTS

| | | | |
|---|---|---|---|
| 1,582,274 | 4/1926 | Kaltenbach | 212/66 X |
| 1,865,762 | 7/1932 | Kaltenbach | 212/69 X |
| 1,969,871 | 8/1934 | Bernhard | 212/135 R |
| 3,258,130 | 6/1966 | Mievile | 212/68 |

FOREIGN PATENTS OR APPLICATIONS

| | | | |
|---|---|---|---|
| 1,201,644 | 9/1965 | Germany | 74/410 |

*Primary Examiner*—Robert R. Song
*Assistant Examiner*—John A. Pekar
*Attorney, Agent, or Firm*—Wolfe, Hubbard, Leydig, Voit & Osann, Ltd.

[57] ABSTRACT

A load handling device is disclosed having an improved swing drive assembly including a pivotally mounted swing drive pinion biased against a segmented ring gear by an actuator with a guide roller adjacent the pinion engaging a guide flange concentric with the ring gear to limit the maximum tooth engagement between the pinion and ring gear and thereby provide essentially constant backlash on the pinion gear regardless of eccentricities or other irregularities in the ring gear.

15 Claims, 6 Drawing Figures

48
138
82
70
136
80
72
132
73
132
38
134
4
4
130
80a
120
128
122
124
126
64

SWING DRIVE ASSEMBLY

BACKGROUND OF THE INVENTION

The present invention relates generally to load handling devices and more particularly concerns an improved swing drive assembly for large load handling cranes and the like.

It is known in the art, that the lifting capacity of a load handling drvice, can be increased by providing the device with a large diameter roller path for supporting on rollers an opposed boom and and a counterweight. One example of such a device is shown in U.S. Pat. No. 3,485,383. Such arrangements have afforded marked increases in the lifting capacities of the basic unit and have been quite satisfactory for many heavy duty lifting operations.

However, where the duty cycle for the device envolves both lifting and swinging heavy loads, great stress is imposed on the normal swing drive gears of such devices. This, of course leads to rapid wear of conventional swing drive pinions and ultimate failure, particularly where repeated swings are made under heavy load. While attempts have been made in the past to provide outboard, peripheral swing drive arrangements, these have not proved altogether satisfactory, due largely to eccentricities and other irregularities in the outer ring gear, leading to widely varying backlash on the driving pinion. Although, presumably this problem could be overcome by precision fabrication of the outer ring gear to insure concentricity of the ring and uniformity of teeth formation within close tolerances, even with todays' technology, this would be nearly prohibitively expensive.

According, it is the primary aim of the present invention to provide an improved swing drive assembly for heavy load handling devices which does not require machining large ring gear components to close tolerances.

It is a further object to provide such an improved swing drive assembly which is designed to provide substantially constant backlash on the swing drive pinion thus reducing stresses and prolonging swing gear life.

A more detailed object is to provide a swing drive assembly of the above type which includes means for maintaining the extent of tooth engagement between the driving pinion and the stationary ring gear uniform and constant regardless of eccentricities or other irregularities therein.

It is also an object of the invention to provide a swing drive assembly which may employ a large ring gear made up of a plurality of arcuate segments and/or a ring gear in which the teeth need not be precision machined, but instead may be formed by flame cutting, for example.

A still further detailed object of the invention is to provide an improved swing drive arrangement in which the force of maintaining a constant backlash on the swing drive pinion is imposed on the structure of the outer supporting roller path rather than being transmitted to the contral pivot of the rotating device.

Other objects and advantages of the invention will become apparent upon reading the following detailed description and upon reference to the drawings, in which.

While the invention will be described in connection with certain preferred embodiments, it will be understood that we do not intend to limit the invention to those embodiments. On the contrary, we intend to cover all alternatives, modifications and equivalents as may be included within the spirit and scope of the invention as defined by the appended claims.

Figure 1:
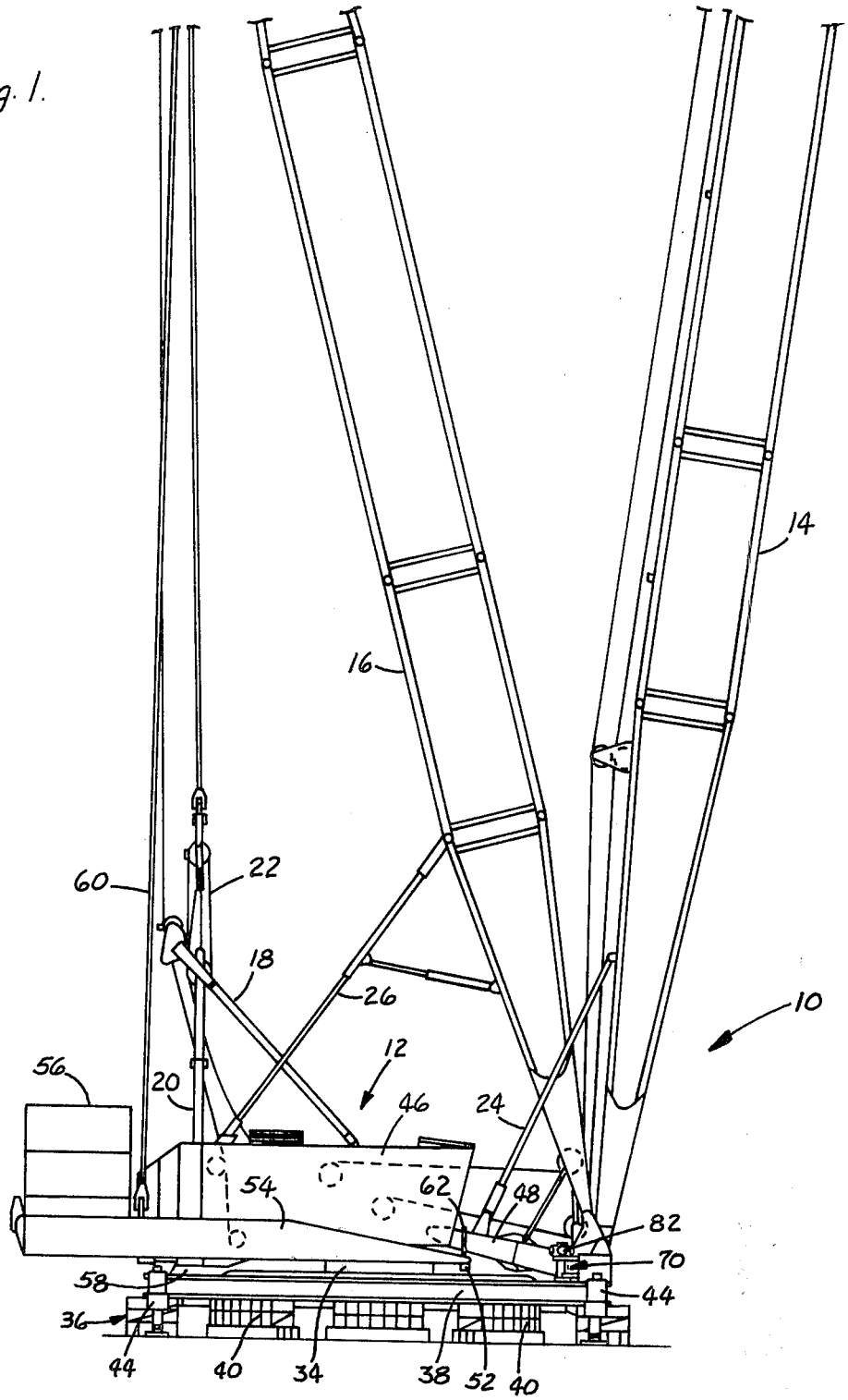
FIG. 1 is a fragmentary side elevation of a load handling device, in the form of a crane, with which the present invention is particularly associated.

Turning now to the drawings, there is shown in FIG. 1, a load handling device in the form of a large crane assembly, 10 with which the present invention is associated. The illustrated crane assembly 10 includes upper works 12 which carries a boom 14, mast 16, gantry 18, backhitch 20 and boom hoist rigging 22. Preferrably, cushioned stops 24 and 26 are provided for the boom 14 and mast 16.

Figure 2:
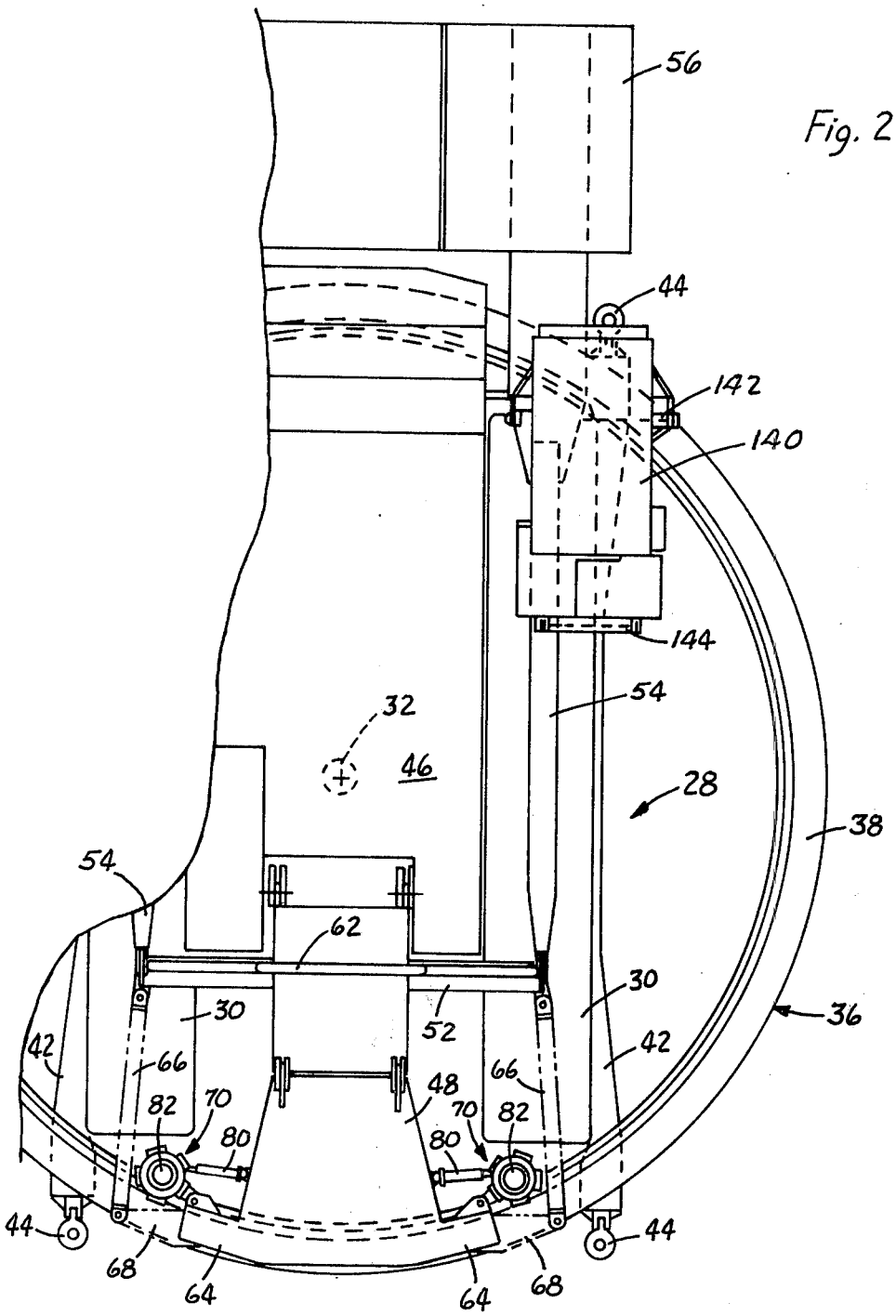
FIG. 2 is an enlarged fragmentary plan view of the crane in FIG. 1 showing a portion of the ring gear and roller path on which the crane is mounted.

As shown in FIG. 2, the basic unit of the illustrate crane assembly 10 is of the self-propelled type including lower works 28 normally supported by a pair of crawler track assemblies 30. It will be appreciated as the description proceeds, however, that the basic crane assembly could be normally supported by other types of self-propelled lower works or, indeed, it could be of a stationary nature. In either case, the lower works 28 are provided with a central pivot post 32 about which the upper works 12 rotates. When a self-propelled unit is utilized, as in the illustrated embodiment, the lower works 28 are further provided with a ring gear and roller path assembly 34 (See FIG. 1) for normally supporting the upper works 12 during mobile operation.

The crane assembly 10 also includes an annular ring support structure 36, as shown in FIGS. 1 and 2, of the general type disclose in U.S. Pat. No. 3,485,383. Basically, this ring support 36 includes a reinforced roller path 38 supported above the ground on blocks 40 or the like. The lower works also includes a pair of laterally spaced supporting frames 42 which span the roller path 38 and which are rigidly secured thereto. In the illustrated embodiment, one of the frames 42 is mounted on the outside of each of the track assemblies 30 and carries a jack 44 at each end. Thus, the crane lower works 28 is tied rigidly to the ring support structure, while the upper works 12 is rotatable about the central pivot post 32. (See FIG. 2)

The upper works 12 also includes a central machinery section 46 housing power source and the principal winch drums for the load hoist and boom hoist lines. Extending forwardly from the central machinery section 46 and pivotally secured thereto is a boom support 48, the outer end of which overlies and is supported by front rollers (not shown) on the roller path 38. The boom 14 is pivotally mounted on the upper side of the support 48 above the front rollers. Intermediate the ends of the boom support 48 is a cross beam 52 to which a rearwardly extending counterweight support beam 54 is pivotally mounted adjacent each end. A large counterweight 56 is carried by the beams 54 which, in turn, are normally supported on the roller path 38 by rear roller assemblies 58. The supporting beams 54 and counterweight are also suspended from the mast 16 by counterweight supporting pendants 60 when a heavy load is suspended from the boom 14.

Though differing somewhat in detail, the boom 14, boom support 48, central machinery section 46, counterweight 56 and counterweight supporting beams 54 follow the teaching disclosed, in U.S. Pat. No. 3,485,383. To provide additional strength to the cross beam 52, its ends may be supported by a truss frame 62 which bridges the rear end of the boom support 48.

Referring more particularly to FIG. 2, the forward end of the boom support includes a pair of laterally extending wings 64 which are generally box shaped in cross-section and which preferrably house the front supporting rollers (not shown). In addition, to provide increased rigidity to the upper works 12, particularly for resisting twisting movements between the counterweight 56, supporting beams 54 and the boom support 48 during swinging of heavy loads, a pair of optional struts 66 may be connected to the ends of the cross beam 52 and ears 68 rigidly connected to the wing portions 64 of the boom support 48. (See FIG. 2).

Pursuant to the present invention, an improved swing drive assembly 70 is provided for rotating the upper works 12 relative to the ring support structure 36 and rigid lower works 28. In the preferred embodiment, an internally toothed ring gear 72 is rigidly secured on the inner periphery of the roller path 38 and the boom support 48, which acts as a frame element, carries a pivotal link 73 which supports a drive pinion 74 journalled for engagement with the ring gear 72. Concentric with the ring gear 72, a guide flange 76 is mounted on the inner periphery of the roller path 38 and a guide roller 78 is mounted concentric with the pinion 74.

Actuator means 80 are provided for urging the pinion 74 into engagement with the ring gear 72 and the guide roller 78 into engagement with the guide flange 76. By properly dimensioning the diameter of the guide roller 78 relative to the depth of the teeth on the pinion 74 and ring gear 72 the extent of engagement of the respective teeth can be regulated so as to maintain the backlash on the pinion 74 substantially constant regardless of eccentricities or other irregularities in the formation of the ring gear 72.

Because of the foregoing, the roller path 38 and the ring gear 72 may be formed of a plurality of arcuate segments bolted or otherwise rigidly secured together at the job site. Likewise, the guide flange 76 may also be formed in arcuate segments, but, preferrably, it is rigidly and accurately secured to its companion ring gear segment such as by welding.

It will also be understood that since the guide roller 78 maintains the engagement of the teeth on the pinion 74 and ring gear 72 substantially constant, precision machining of the ring gear teeth to close tolerances is not essential. Rather, the ring gear teeth may be cut with reasonable accuracy even by current flame-torch cutting techniques. Moreover, while the ring gear 72 and guide flange 76 are shown in the illustrated embodiment secured to the inner periphery of the roller path 38, it should be appreciated that they could be secured to the outer periphery. In that case, of course, the pinion 74 and guide roller 78 would likewise be mounted outboard of the roller path 38 and would be urged inwardly into respective engagement with the ring gear 72 and guide flange 76.

Figure 4:
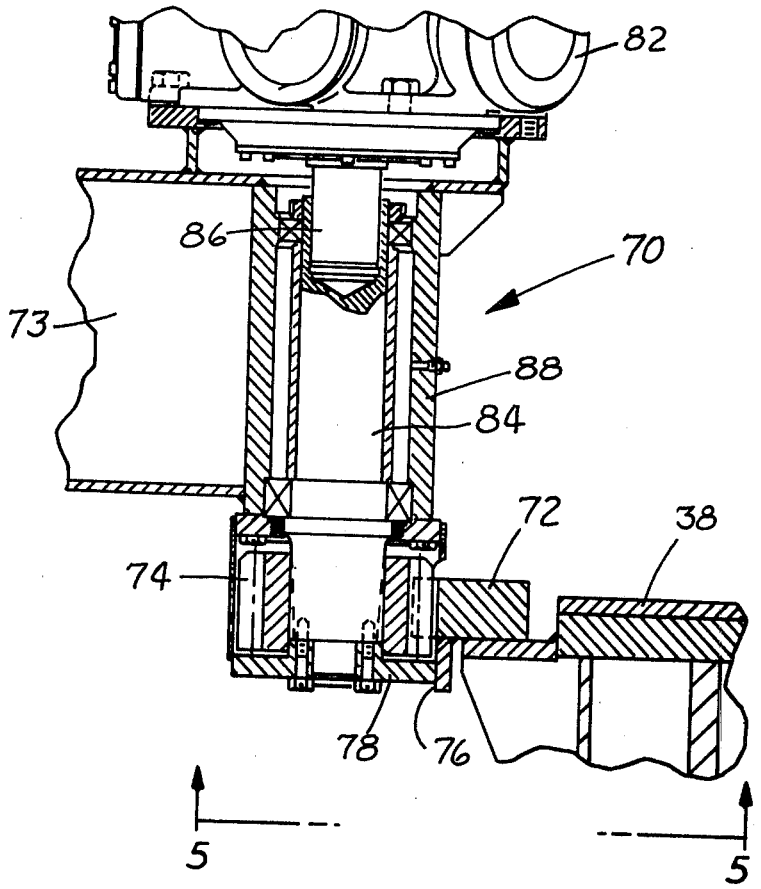
FIG. 4 is an enlarged partial section taken substantially in the plane of line 4—4 in FIG. 3.
Figure 5:
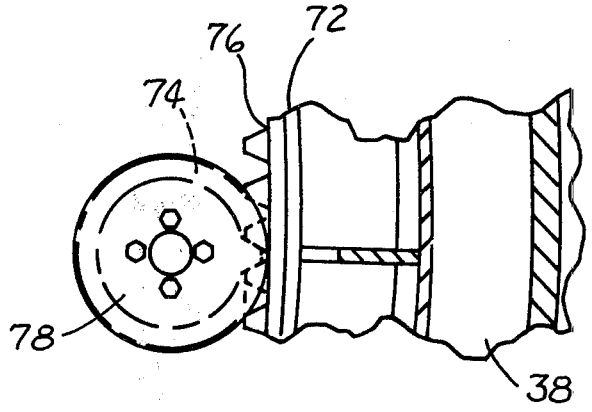
FIG. 5 is a section taken substantially in the plane of line 5—5 in FIG. 4; and, FIG. 6 is a schematic diagram of the hydraulic circuit for the swing drive assembly of the present invention.
Figure 6:
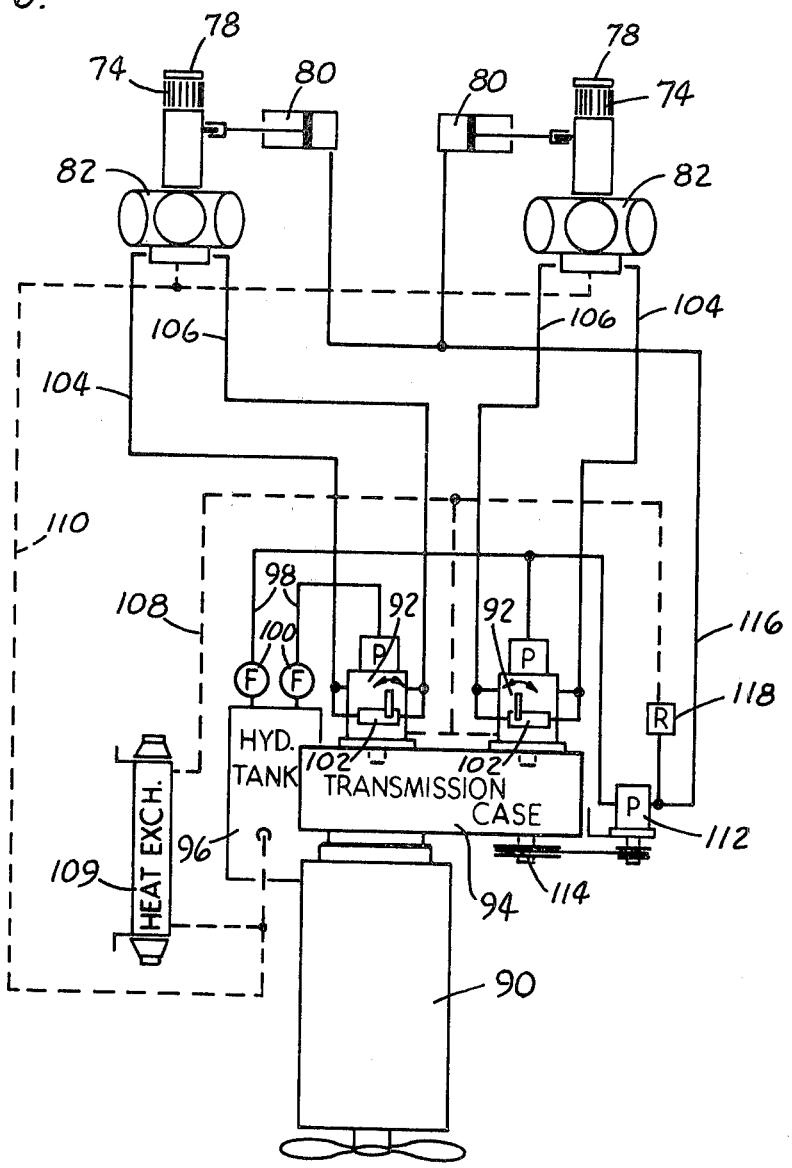

For driving each of the pinion 74 a reversable hydraulic motor 82 is supported by the links 73 and a pinion drive shaft 84 is splined to the output shaft 86 of the motor 82. The shaft 84 is journalled in bearings mounted in a housing 88 at the free end of the link 73, (See FIG. 4). Referring now to FIG. 6, there is shown a schematic diagram of the power source and hydraulic circuit for driving the swing drive motors 82. The power source preferrably includes an internal combination engine 90 which drives a pair of variable displacement, reversable output pumps 92 through a transmission case 94.

Hydraulic fluid is drawn by the pumps 92 from a tank 96 through supply lines 98 each having a filter 100 therein. Each of the pumps 92 has a control 102 for regulating the pump displacement and the direction of discharge through reversable supply/return lines 104, 106 coupled to each of the motors 82. The casing of each of the pumps 92 also drains to a sump line 108 connected to the tank 96 and has a heat exchanger 109 therein. A return line 110 also is provided to drain oil leakage from the casings of the motors 82.

To supply fluid to the actuators 80, the engine 90 also drives a fixed displacement pump 112 from an output shaft 114 on the transmission case 94. The pump 112 draws fluid from the tank 96 through one of the supply lines 98 and delivers fluid to the actuators 80 through a delivery line 116. A pressure relief valve 118 is connected to the delivery line so that the pressure delivered to the actuators 80 is maintained constant when the swing drive assembly is in operation. The pressure relief valve 118 discharges into the sump line 108.

The engine 90, pumps 92, 112 hydraulic tank 96 and heat exchanger 109 may be mounted at any convenient location on the crane upper works 12. As shown in FIG. 2 in the illustrated embodiment an enclosed power plant housing 140 is supported by frame members 142, 144 mounted on one of the counterweight support beams 54. The engine, pumps and tank are enclosed within the housing 120 and the supply/return lines 104, 106, 110 and 116 of course extend out to the motors 82 and actuators 80.

Figure 3:
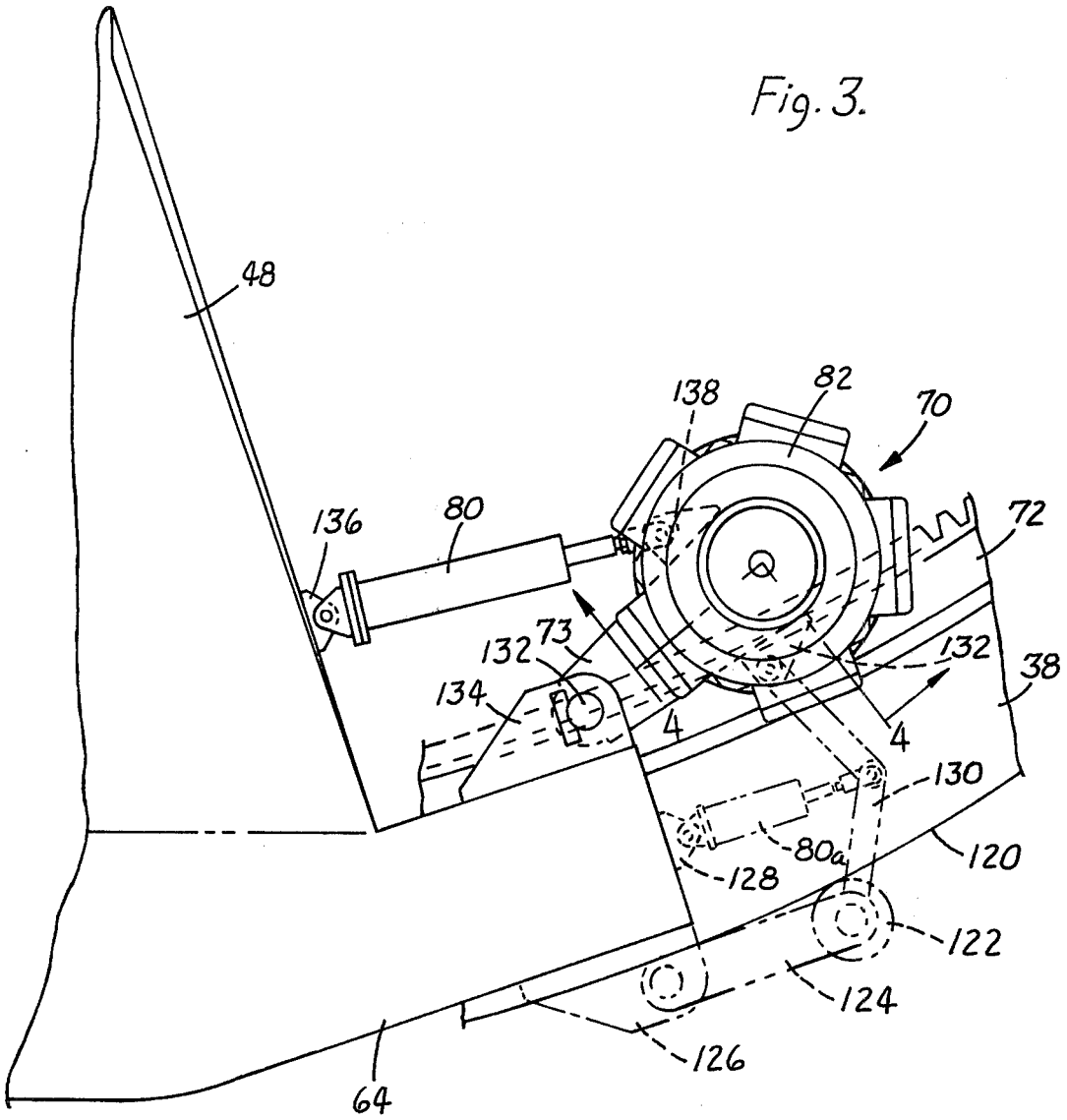
FIG. 3 is a further enlarged fragmentary plan view, showing in solid lines, one of the swing drive assemblies of the present invention, and in dash lines a modified embodiment thereof.

In keeping with a further modification of the invention, means are provided for applying the load resulting from the actuator force to the structure of the roller path 38 rather than transmitting this force back through the boom support 48 to the central pivot 32. To this end and as shown in FIG. 3 the roller path 38 is provided with an outer peripheral roller face 120 against which a squeeze roll 122 is engaged. The roller 122 is mounted on a lever arm 124 pivotally mounted on a bracket 126 secured to the wing 64. In this embodiment, the actuator 80a is anchored at one end on a lug 128 secured to the wing 64 and at the other end is pinned to a toggle linkage 130 interconnecting the lever arm 124 and another lug 132 secured to the motor 82. As will be apparent, when the actuator is retracted, the pinion 74 and guide roller 78 are drawn into engagement with the ring gear 72 and guide flange 78 and this force is opposed by the squeeze roller 122 engaging the roller face 120 on the outer periphery of the roller path 38.

Also as shown in FIG. 3, the link 73 is pinned at 132 on a bracket 134 secured to the wing 64. The actuator 80 is pinned at one end to a lug 136 on the boom support 48 and at the other end to a lug 138 on the motor 82. Preferrably the link 73 is disposed substantially tangentially to the pitch line of the pinion 74 and ring gear 72 so that the driving force is imparted essentially through the axis of the pin 132 in the bracket 134. While two pinions 74 are shown in the illustrated embodiment supported by links 73 pivoted to brackets 134 on the boom support 48, it will be appreciated that additional pinions 74 and drive motors can be provided and they may be mounted on other frame elements extending outwardly from the upper works 12 to adjacent the roller path 38.

From the foregoing, it will be seen that the present invention provides an improved swing drive assembly for heavy duty crane assemblies rotatably supported on large diameter roller paths. By providing a guide roller 78 engageable with a guide flange 76 the backlash of the pinion gear 74 can be maintained substantially constant regardless of eccentricities or other irregularities in the ring gear 72. Moreover the ring gear 72 may be formed of a plurality of arcuate segments if desired and the teeth may be unexpensively cut by flame-torch methods.

We claim:

1. A swing drive assembly for a load handling device having upper works rotatable about a central pivot and supported by rollers on a roller path disposed substantially concentrically with said pivot, comprising, in combination, a frame element mounted on said upper works and extending outwardly therefrom to adjacent said roller path, means defining a ring gear secured to one peripheral edge of said roller path, mounting means on said frame element for journalling a pinion gear for normal engagement with said ring gear and for moving said pinion gear toward and away from said ring gear, a guide flange mounted on said roller path concentric with said ring gear, a guide roller supported by said frame element and journalled for engagement with said flange, means including a reversible hydraulic motor for driving said pinion against said ring gear so as to swing said upper works about said pivot, actuator means including a hydraulic actuator for urging said pinion toward said ring gear and said roller into engagement with said flange so as to maintain substantially constant backlash between said pinion and ring gear regardless of eccentricities in said roller path, and hydraulic pump means for selectively pressurizing said motor and for constantly pressurizing said actuator during swing drive operation.

2. A swing drive assembly as defined in claim 1 wherein said pump means includes a variable displacement reversable discharge pump for said motor and a fixed displacement pump with a pressure relief valve for said actuator.

3. A swing drive assembly as defined in claim 1 including a plurality of arcuately spaced drive pinion and guide roller assemblies, with each assembly having actuator means for urging said pinion toward said ring gear and said roller into engagement with said flange.

4. A swing drive assembly as defined in claim 1 wherein said ring gear and guide flange are secured to the inner periphery of said roller path, said actuator means urges said pinion outwardly into engagement with said ring gear and said guide roller limits the maximum extent of engagement between the teeth on said pinion and ring gear.

5. A swing drive assembly as defined in claim 1 wherein said pinion gear and guide roller are concentrically mounted, said mounting means includes a link pivotally mounted on said frame element for supporting said pinion and roller, and said link is disposed substantially tangentially to the pitch line of said pinion and ring gear.

6. A swing drive assembly as defined in claim 5 wherein said actuator means is disposed between said link and frame element for swinging said pinion and guide roller respectively into engagement with said ring gear and guide flange.

7. A swing drive assembly as defined in claim 5 wherein said roller path includes another peripheral roller face parallel to and concentric with said guide flange, a lever is pivotally mounted on said frame element for journalling a squeeze roller in rolling engagement with said face, and said actuator means interconnects said link and said lever for urging said guide roller and said squeeze roller toward one another.

8. A swing drive assembly as defined in claim 1 wherein said ring gear and guide flange are made of arcuate segments secured to the periphery of said roller path.

9. A swing drive assembly for a load handling device having upper works rotatable about a central pivot and supported by rollers on a roller path disposed substantially concentrically with said pivot, comprising, in combination, a frame element mounted on said upper works and extending outwardly therefrom to adjacent said roller path, means defining a ring gear secured to one peripheral edge of said roller path, mounting means including a link pivotally mounted on said frame element for journalling a pinion gear for normal engagement with said ring gear and for moving said pinion gear toward and away from said ring gear, a guide flange mounted on said roller path concentric with said ring gear, a guide roller supported by said link and journalled concentrically with said pinion for engagement with said flange, said link being disposed substantially tangentially to the pitch line of said pinion and ring gear, means for driving said pinion against said ring gear so as to swing said upper works about said pivot, and actuator means for urging said pinion toward said ring gear and said roller into engagement with said flange so as to maintain substantially constant backlash between said pinion and ring gear regardless of eccentricities in said roller path.

10. A swing drive assembly as defined in claim 9 wherein said pinion drive means includes a reversable hydraulic motor and said means for urging said pinion toward said ring gear includes a hydraulic actuator, and hydraulic pump means are provided for selectively pressurizing said motor and for constantly pressurizing said actuator during swing drive operation.

11. A swing drive assembly as defined in claim 10 wherein said pump means includes a variable displacement reversible discharge pump for said motor and a fixed displacement pump with a pressure relief valve for said actuator.

12. A swing drrive assembly as defined in claim 9 wherein said actuator means is disposed between said link and frame element for swinging said pinion and guide roller respectively into engagement with said ring gear and guide flange.

13. A swing drive assembly as defined in claim 9 wherein said roller path includes another peripheral roller face parallel to and concentric with said guide flange, a lever is pivotally mounted on said frame element for journalling a squeeze roller in rolling engagement with said face, and said actuator means interconnects said link and said lever for urging said guide roller and said squeeze roller toward one another.

14. A swing drive assembly as defined in claim 9 including a plurality of arcuately spaced drive pinion and guide roller assemblies, with each assembly having actuator means for urging said pinion toward said ring gear and said roller into engagement with said flange.

15. A swing drive assembly as defined in claim 9 wherein said ring gear and guide flange are secured to the inner periphery of said roller path, said actuator means urges said pinion outwardly into engagement with said ring gear and said guide roller limits the maximum extent of engagement between the teeth on said pinion and ring gear.

* * * * *